US006203242B1

(12) United States Patent
Englund

(10) Patent No.: US 6,203,242 B1
(45) Date of Patent: Mar. 20, 2001

(54) CRASH BARRIER AND BARRIER ELEMENTS

(75) Inventor: Gunnar Englund, Mora (SE)

(73) Assignee: Gunnar Englund Byggare Ab, Mora (SE)

( * ) Notice: Subject to any disclaimer, the term of this patent is extended or adjusted under 35 U.S.C. 154(b) by 0 days.

(21) Appl. No.: 09/445,771

(22) Filed: Feb. 17, 2000

(30) Foreign Application Priority Data

Feb. 10, 1998 (SE) ..... 9800376

(51) Int. Cl.[7] ..... E01F 13/00
(52) U.S. Cl. ..... 404/6; 404/9; 256/13.1
(58) Field of Search ..... 404/6, 9; 256/13.1

(56) References Cited

U.S. PATENT DOCUMENTS

| | | | | |
|---|---|---|---|---|
| 4,661,010 | | 4/1987 | Almér et al. . | |
| 4,681,302 | * | 7/1987 | Thompson | 256/13.1 |
| 4,815,889 | * | 3/1989 | Duckett | 404/6 |
| 4,828,425 | | 5/1989 | Duckett . | |
| 5,074,704 | * | 12/1991 | McKay | 404/6 |
| 5,403,113 | * | 4/1995 | Gertz et al. | 404/6 |
| 5,464,306 | * | 11/1995 | Cristiano | 404/6 |
| 5,605,413 | * | 2/1997 | Brown | 404/6 |
| 5,628,582 | * | 5/1997 | Nagle | 404/6 |

FOREIGN PATENT DOCUMENTS 2562576 4/1984 (FR) .

* cited by examiner

*Primary Examiner*—Eileen D. Lillis
*Assistant Examiner*—Raymond W Addie
(74) *Attorney, Agent, or Firm*—Burns, Doane, Swecker & Mathis LLP

(57) ABSTRACT

The present invention relates to a crash barrier which is adapted to be arranged in the middle of a dual carriageway and which is composed of a plurality of elongate barrier elements (1), preferably made of concrete, which are arranged successively with the short side of the respective barrier elements neighboring each other. Neighboring barrier elements (1, 1') are interconnected by means of articulated connections (5, 6, 5', 6', 8) which prevent lateral displacement of the interconnected short sides relative to each other, but permit force-absorbing deformation of the crash barrier by pivoting of the barrier elements relative to each other in case a vehicle collides with the crash barrier. Each barrier element has at least two projecting connecting elements (5, 6) from each short side, which are connected with corresponding connecting elements (5', 6') of a neighboring barrier element (1') by means of a rod (8) which is passed through holes (7) in each connecting element. A sleeve (9) cast into the barrier element (1) permits limited displacement of the connecting elements (5, 6) between two end positions.

7 Claims, 3 Drawing Sheets

Figure 1:
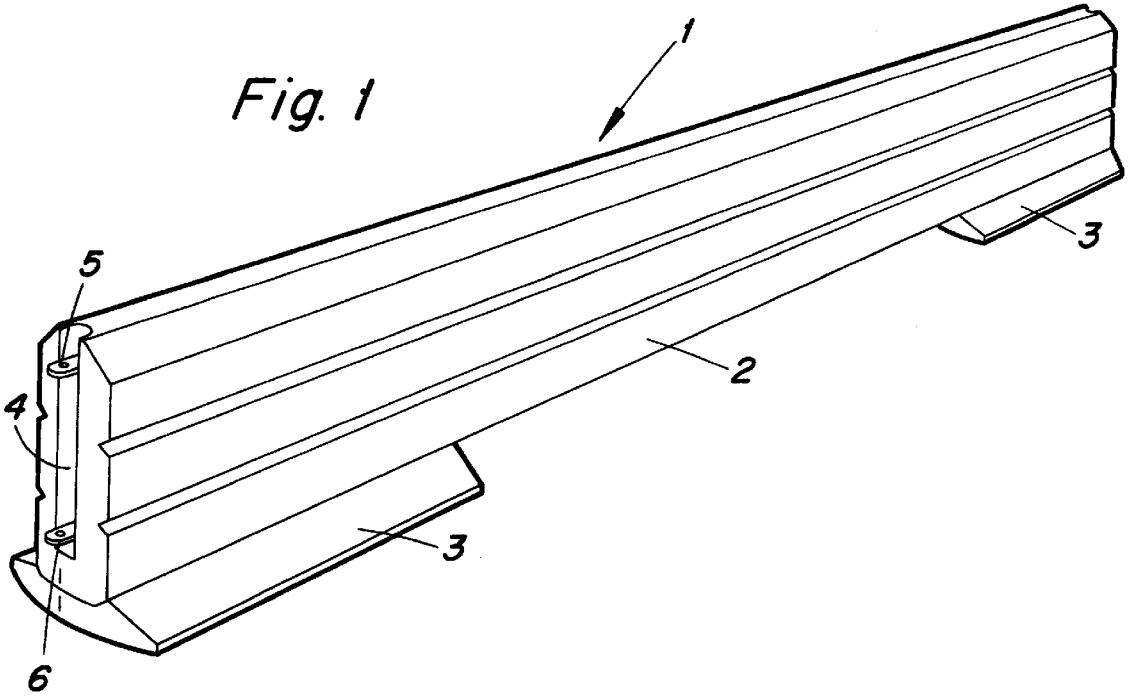

1
2
3
3
4
5
6

5
5'
4
2
12
8
6
6'

CRASH BARRIER AND BARRIER ELEMENTS

This Application claims foreign priority benefits from PCT SE99/00152 with the International filing date of Feb. 5, 1999. Which claims further priority from SE 9800376-7 filed on Feb. 10, 1998.

The present invention relates to a crash barrier which is adapted to be arranged in the middle of a dual carriageway and which is composed of a plurality of elongate barrier elements, preferably made of concrete, which are arranged successively with their short sides directed towards each other, and which are interconnected by means of an articulated connection which prevents lateral displacement of the interconnected short sides of neighbouring barrier elements in relation to each other but permits force-absorbing deformation of the crash barrier by pivoting of the barrier elements relative to each other and limited longitudinal displacement of the barrier elements in relation to each other when a vehicle collides with the crash barrier, each barrier element having at least two protruding connecting elements from each short side, which are connected with corresponding connecting elements of a neighbouring barrier element by means of a rod which is passed through holes in each connecting element.

BACKGROUND ART

In connection with roads and particularly large ones for traffic at high speeds, such as motorways and expressways, it is frequently desirable to separate the carriageways by some sort of collision-preventing shielding or crash barrier. This applies specifically between carriageways with traffic in opposite directions, for instance in the middle of the road, to prevent vehicles from coming over, by mistake or in accidents, to the carriageway where vehicles come from the other direction at the risk of the vehicles crashing head-on.

Moreover, it has recently become more and more common to build alternative motorways at a lower cost where carriageways with traffic in opposite directions are not separated by a broad central reserve in the form of e.g. a bank or a ditch, such as on conventional motorways, but such opposite carriageways adjoin each other. Since on such motorways the vehicles frequently travel at high speed and, consequently, a head-on collision becomes devastating, it is usually a requirement that some sort of crash barrier be arranged between carriageways with vehicles coming from opposite directions.

Different types of crash barrier to be used as a shielding separating the carriageways are already known. The most common type is a barrier in the form of elongate, horizontal beams or sections which are mounted on posts buried in the roadway. Such barriers are disadvantageous since they are expansive and time-consuming both to mount and to repair after being damaged, and they have poor collision properties since vehicles striking against them usually bounce back into their own carriageway at the risk of colliding with vehicles travelling in the same direction. Furthermore, the posts themselves-constitute a security risk since they are basically stationary obstacles having a small capability, or none at all, of deformation and gentle absorption of collision forces.

A different type of crash barrier, which recently has become more and more frequent, is wires stretched between posts buried in the roadway. This type of crash barrier suffers from essentially the same drawbacks as the above-mentioned ones. Besides, wires are highly elastic and can, to a still greater degree than crash barriers, cause a vehicle to be thrown back on the carriageway from where it is coming. At high speeds, narrow wires moreover obtain cutting properties which may cause severe damage both to materials and to people.

It is also known to assemble a crash barrier of homogeneous and heavy concrete wall elements. The concrete elements comprise an upwardly extending wall portion and a lower base portion. The crash barrier is composed of a plurality of such barrier elements successively arranged in a row, the base portions being arranged directly on the roadway. The short sides of the barrier elements are connected with cooperating grooves and flanges. Such crash barriers are based on the principle that their mass is to be so great that in a collision they are not dislodged at all or at least but to a very small extent. In a possible collision, they will therefore act as a solid wall with no possibility of soft absorption of the collision forces. If an individual barrier element is dislodged to a very small extent, its short sides, however, will be uncovered, which, besides being sharp, act most unresiliently when being struck since they are supported by a plurality of barrier elements arranged in a row behind the first one. Such barrier elements are, owing to their great mass per unit of length, expensive to buy and time-consuming to mount. However, they are also costly and time-consuming to repair after a collision since individual barrier elements cannot be easily exchanged because of the grooves and flanges which engage each other.

U.S. Pat. No. 4,828,427 discloses a crash barrier according to the preamble to claim 1. In this crash barrier, the barrier elements are made of concrete and interconnected by an articulated connection which consists of two connecting elements projecting from the short sides of each barrier element in the form of a bracket. Through holes are formed in the brackets so that two neighbouring barrier elements can be connected to each other by means of a rod extending through the holes in the brackets. As a result, the barrier elements are articulated to each other, and if a vehicle strikes against the crash barrier, it can be deformed without the barrier elements being separated from each other. One of the brackets connected in pairs has an elongate hole, which means that there is a clearance between the hole in the connecting element and the rod extending through the holes. This clearance makes it possible for the barrier elements to be displaced a limited distance in the longitudinal direction relative to each other. The articulated connection further comprises a spring element which puts two neighbouring barrier elements in an intermediate starting position from which the barrier elements are movable both towards and away from each other. The brackets are connected with the barrier elements by means of a nut which is screwed onto threaded pin ends projecting from each barrier element. In case of a collision, the articulated connections will be exposed to extreme forces, and in the articulated connection construction disclosed in the above-mentioned US patent specification there is a great risk that the brackets and the rods will be deformed if a vehicle strikes against the crash barrier. When restoring the barrier after a collision, it may therefore be necessary to repair the barrier-elements and exchange damaged parts, in certain cases even entire barrier elements. Among other things, the clearance between the throughgoing rod and the holes in the brackets will expose the articulated connections to great impact forces. There is also a great risk that the posts to which the brackets are attached will be pulled out of the concrete. In serious cases, there is also a risk that the articulated connections will break in case of a collision, which causes the barrier elements to be completely separated from each other and the collision-protecting properties of the barrier thus deteriorating to a considerable extent. By the articulated connection having a spring element which puts two neighbouring barrier elements in an intermediate starting position, two neighbouring barrier elements will in the starting position be spaced apart to a certain degree. Apart from this, it would besides not be possible to put the barrier elements closely together since in that case the rod could not be contained between them. This is disadvantageous on the one hand from the aesthetic point of view and, on the other hand, owing to the fact that a colliding vehicle runs the risk of getting stuck in the relatively wide joints.

DESCRIPTION OF THE INVENTION

The present invention aims at obviating problems and drawbacks of prior-art crash barriers of the type mentioned by way of introduction. More specifically, the invention aims at providing a crash barrier, in which the articulated connections between the individual barrier elements are designed to resist great forces in case of a collision without being deformed or breaking. This ensures great collision safety and/or reduced expenses for repair and exchange when restoring the barrier after a collision.

In a crash barrier according to the invention, use is made of its mass or weight in combination with the fact that neighbouring barrier elements are articulated to each other by means of a suitably designed articulated connection. This implies that in case of a collision, the crash barrier is laterally displaceable a limited distance by individual barrier elements being pivotable relative to each other, but since the barrier elements are held together in the longitudinal direction, the terminal edges of the barrier elements are at the same time prevented from being uncovered. Such terminal edges are extremely dangerous in a collision since in practice they act as a stationary obstacle which is supported by the weight of a long row of barrier elements. By adjusting the mass per unit of length of the crash barrier, the degree of lateral displacement can be controlled at a given collision force. In a carriageway-separating crash barrier, it is in fact important for the lateral displacement not to be too great so that the crash barrier is moved into the adjoining carriageway.

According to the invention, the articulated connection between neighbouring barrier elements is to a limited extent displaceable or extensible in the longitudinal direction of the barrier elements. As a result, the individual barrier elements in the assembled crash barrier will act as links in a chain and the crash barrier becomes, from a maximally retracted position, which it holds in an undamaged starting position, extensible to a limited extent when the crash barrier locally achieves a greater length owing to a greater distance between neighbouring barrier elements. In this manner, the lateral displacement of individual barrier elements in case of a collision is facilitated by the fact that the increasing length allows more easily that the crash barrier is located in a bend in the area round the collision point. The limited longitudinal movability of the articulated connections, however, ensures that the lateral displacement does not become too great since, when the displacement is so great that the maximum longitudinal displacement is achieved in neighbouring articulated connections, neighbouring barrier elements will, by their weight, counteract further lateral displacement. The greater the collision force, the more barrier elements will be "dragged along" and brake the force. This also creates the possibility of the degree of lateral displacement at a given collision force being controllable, not only by adjusting the mass per unit of length of the barrier, but also by controlling the permissible maximum longitudinal displacement in the articulated connection.

The inventive articulated connections are designed as lugs or connecting elements, such as brackets, projecting from the short sides of each barrier element. The opposite brackets in neighbouring barrier elements are slightly vertically displaced relative to each other and each have a through, preferably circular hole in the outer end. When the barrier elements are joined end-to-end, a preferably circular-cylindrical rod can thus be passed through holes which are aligned one above the other and which have a diameter which is only insignificantly greater than the holes in the connecting elements.

The invention is based on the understanding that the above-mentioned objects can be achieved by the longitudinal displaceability between individual barrier elements being provided by the fact that each of the connecting elements is displaceably arranged in a sleeve cast into the concrete. Such a construction can be made very strong by five sides of the sleeve being enclosed by structural concrete which efficiently prevents deformation and breakage. According to a preferred embodiment, the connecting element is made with an elongate hole and a vertically oriented rod extends through the sleeve and through the elongate hole in the connecting element. As a result, the rod and the terminal edges of the hole will define the outermost end positions of the connecting element. The rod will thus be completely embedded in the concrete except the short distance through the sleeve, and this reduces to a considerable extent the risk of breakage and deformation of the rod. The area round each sleeve can conventionally be reinforced to prevent cracking and breakage in the concrete owing to tensile forces occurring in connection with a collision.

In a further preferred embodiment, each barrier element is formed with a vertical, groove-shaped recess on each short side, in which the articulated connections including the rod can be completely contained and concealed. This makes it possible to completely join two neighbouring barrier elements. This is advantageous on the one hand from the aesthetic point of view by the articulated connections not being visible from outside and, on the other hand, by the fact that a colliding vehicle does not run the risk of getting stuck in joints arising between the barrier elements.

The size and shape of an individual barrier element can be varied within wide limits. In the preferred embodiment, its length is about 6 m, its width about 25 cm and its height about 85 cm. The weight of such a barrier element will be about 3 tonnes, i.e. about 500 kg/m, but may vary between about 400 and 600 kg/m.

BRIEF DESCRIPTION OF ACCOMPANYING DRAWINGS

Figure 4:
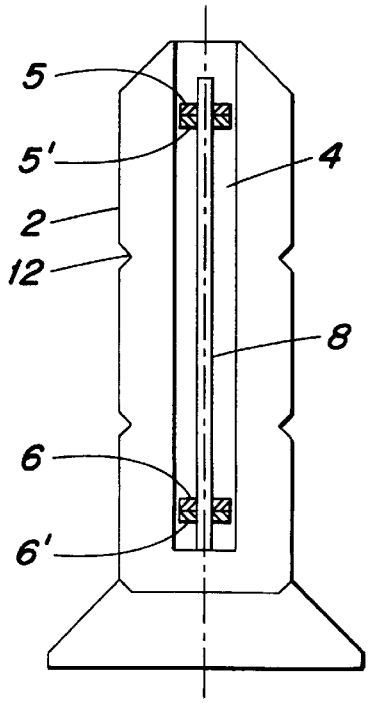
Figure 2:
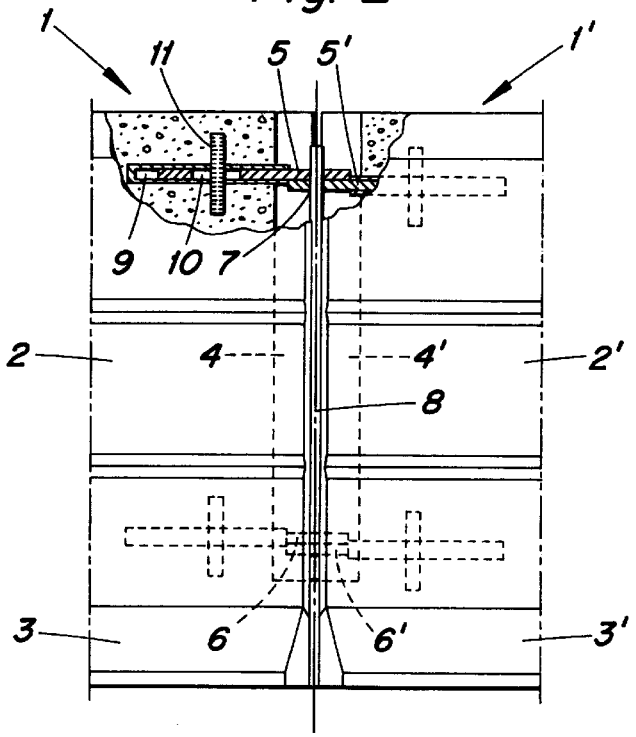
Figure 3:
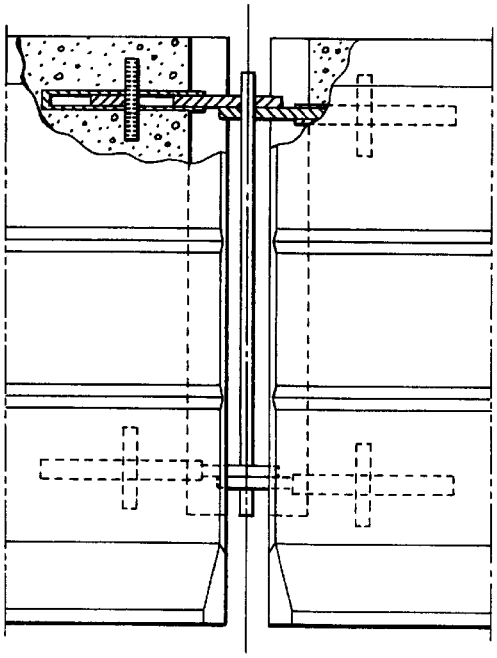
Figure 5:
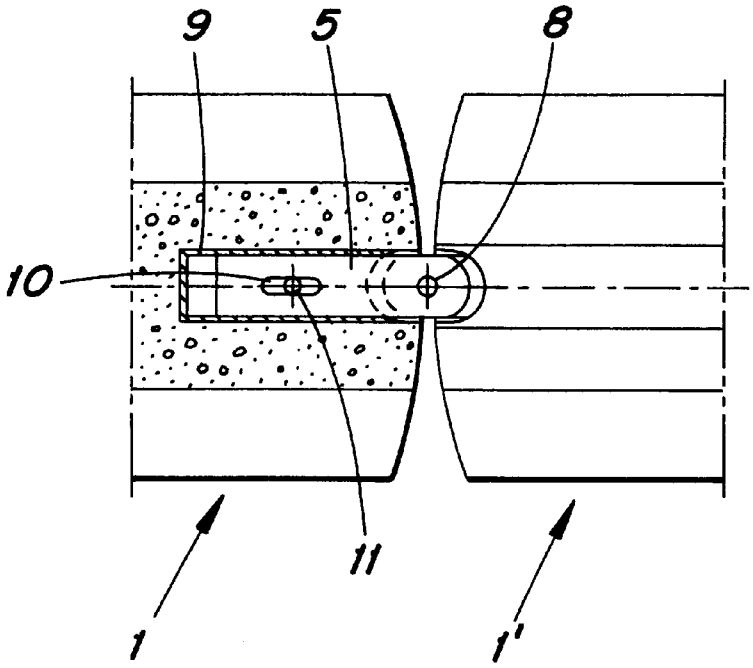
Figure 6:
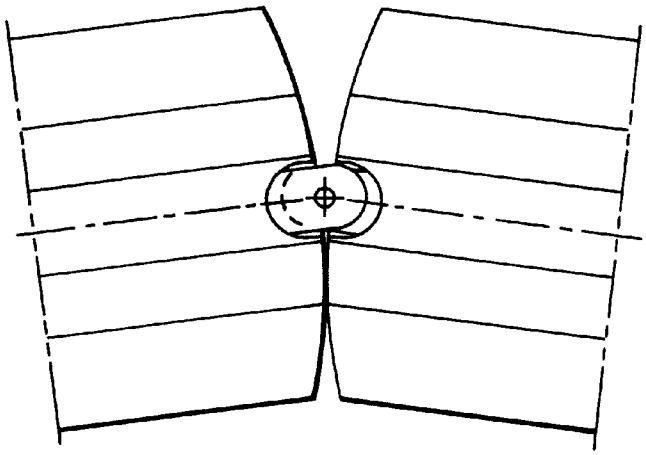

In the drawings,

FIG. 1 is a perspective view, obliquely from above, of a barrier element according to a preferred embodiment of the invention, FIG. 2 is a cross-sectional side view illustrating an articulated connection between two neighbouring barrier elements in a joined state, FIG. 3 is a side view according to FIG. 2, the barrier elements being in a separated state, FIG. 4 is an end view of a barrier element, FIG. 5 is a part-sectional top plan view of the connection between two neighbouring barrier elements which are aligned with each other, and FIG. 6 is a top plan view corresponding to FIG. 5, the barrier elements being angled relative to each other.

DETAILED DESCRIPTION OF A PREFERRED EMBODIMENT OF THE INVENTION

FIG. 1 is a perspective view of a preferred embodiment of a barrier element 1 according to the invention. This comprises on the one hand an elongate vertical wall portion 2 and, on the other hand, base plates 3 arranged under each end portion of the wall portion. Preferably, the wall portion and the base plates are integrated and suitably cast in the same casting operation. The base plates have a plane underside and are preferably arranged directly on an asphalt carriageway. Since the base plates extend merely under part of the wall portion, each base plate suitably having a length amounting to about 1.5 m, a central portion of each barrier element will be supported at a distance above the roadway. The free space thus forming is advantageous to permit drainage of rainwater from the roadway. The space can also be used for e.g. electric wiring and the like.

As is also evident from FIG. 1, the short side of the barrier element is formed with a groove-shaped recess 4 which extends from the upper side of the barrier element and is terminated a distance above the base plate. 5 and 6 designate two brackets which project horizontally from the recess. The corresponding recess 4 and brackets 5, 6 are arranged in the opposite short side (not shown) of the barrier element.

Reference is then made to FIGS. 2–6, which illustrate on a larger scale the details of the short sides of the barrier element and also the design and function of an articulated connection between two interconnected barrier elements.

FIG. 2 is a cross-sectional side view of the end portions of two barrier elements 1, 1' which are arranged short side to short side. As is shown, the projecting brackets 5, 6 of the barrier element 1 are located somewhat higher than the corresponding brackets 5', 6' of the barrier element 1'. Each of the brackets is formed with a through hole, generally designated 7, in its outer end portions. When the barrier elements are arranged according to the Figure and the through holes 7 are aligned above each other, a rod 8 can be passed down through the holes and locked in some suitable manner (not shown), for instance by means of a screw joint or a bayonet joint. The barrier elements are then interconnected and the rod 8 will act as a pivot enabling the barrier elements to pivot relative to each other. The recesses 4 and 4' allow insertion and locking of the rod 8 in the holes 7 of the brackets although the barrier elements are closely joined end-to-end. The articulated connection will therefore be concealed in the completed crash barrier.

The brackets 5, 6, 5', 6' are displaceably movable to a limited extent in the longitudinal direction of the barrier element. This is achieved by each bracket being located in a sleeve 9 which has five closed walls and, more specifically, is closed upwards, downwards, sideways and backwards while it is open at its front end. The walls define an inner space which is sufficient to contain the rear part of the bracket. The sleeve 9 is cast into the concrete and merely the front end projects from the recess 4 in the short side of the barrier element. Moreover, the bracket is formed with an elongate hole 10 in the part inserted in the sleeve 9. A short rod or a reinforcing bar 11 extends vertically through the sleeve 9 and the hole 10 in the bracket. The rod 11 will then act on the one hand as an anchor in the concrete by its ends being cast into the concrete and, on the other hand, as an abutment for the movement of the bracket in the longitudinal direction of the barrier element and defines the outer and inner end positions of the bracket. A thus designed articulated connection allows not only the above-mentioned angular pivoting of the barrier elements relative to each other, but also that the barrier elements are to a limited extent longitudinally displaceable relative to each other as illustrated in FIG. 2, where the barrier elements are closely joined, and in FIG. 3 where the barrier elements are maximally spaced from each other.

FIG. 4 is an end view of the cross-sectional shape of the barrier element with the wall portion 2 and the integrated base plate 3. In the outer surface of the wall portion 2, grooves 12 are formed for the purpose of decoration. The Figure also shows the recess 4 in the short side of the barrier element and the rod 8 which is inserted in the holes in the respective brackets 5, 6, 5', 6'.

FIG. 5 is a top plan view of the interconnection of two barrier elements 1, 1'. The left barrier element is cut through so that the sleeve 9 and the inner part of the bracket 5 are visible. In FIG. 5, the barrier elements are aligned with each other while FIG. 6 is a top plan view of the two barrier elements pivoted with their respective longitudinal axes making an angle to each other. This position can be taken after one of the barrier elements has been struck by a vehicle. To facilitate the pivoting of the barrier elements relative to each other, their short sides as well as the short sides of the base plates are rounded, as illustrated in the Figures.

What is claimed is:

1. A crash barrier for being arranged in the middle of a dual carriageway comprising:

a plurality of elongate barrier elements which are arranged successively with their short sides directed towards each other, and an articulated connection which interconnects said plurality of barrier elements and which prevents lateral displacement of the interconnected short sides of neighboring barrier elements in relation to each other but permits force-absorbing deformation of the crash barrier by pivoting of the barrier elements relative to each other and limited longitudinal displacement of the barrier elements in relation to each other when a vehicle collides with the crash barrier when positioned for use, wherein each barrier element includes at least two protruding connecting elements from each short side, which are connected with corresponding connecting elements of a neighboring barrier element by a rod which is passed through holes in each connecting element, wherein, when said crash barrier is positioned for use, the connecting elements are displaceable to a limited extent between two end positions within a sleeve which is cast into the barrier element.

2. A crash barrier as claimed in claim 1, wherein each said barrier element has a mass which is between 400 and 600 kg/m.

3. A crash barrier as claimed in claim 1, wherein the barrier elements have groove-shaped recesses in each short side, the recesses containing and concealing the articulated connections when neighboring barrier elements are joined.

4. A crash barrier as claimed in claim 1, wherein each said barrier element has a mass which is about 500 kg/m.

5. A crash barrier as claimed in claim 2, wherein the barrier elements have groove-shaped recesses in each short side, the recesses containing and concealing the articulated connections when neighboring barrier elements are joined.

6. A crash barrier as claimed in claim 4, wherein the barrier elements have groove-shaped recesses in each short side, the recesses containing and concealing the articulated connections when neighboring barrier elements are joined.

7. A crash barrier as claimed in claim 1, wherein said plurality of barrier elements are formed from concrete.

* * * * *